US005205055A

United States Patent [19]

Harrell

[11] Patent Number: 5,205,055

[45] Date of Patent: Apr. 27, 1993

[54] PNEUMATIC SHOE LACING APPARATUS

[76] Inventor: Aaron D. Harrell, 506 20th St., Virginia Beach, Va. 23451, by Lisa K. Harrell, legal representative

[21] Appl. No.: 829,231

[22] Filed: Feb. 3, 1992

[51] Int. Cl.[5] ..... A43B 11/00

[52] U.S. Cl. ..... 36/50.001; 36/50.5; 36/58.5

[58] Field of Search ..... 36/50.5, 50.1, 58.5, 36/138, 1

[56] References Cited

U.S. PATENT DOCUMENTS

| | | | |
|---|---|---|---|
| 4,408,403 | 10/1983 | Martin | 36/50.5 X |
| 4,449,273 | 5/1984 | Baggio | 36/50.5 X |
| 4,724,626 | 2/1988 | Baggio | 36/50.5 X |
| 4,739,563 | 4/1988 | Guggenberger et al. | 36/50.5 X |
| 4,748,726 | 6/1988 | Schoch | 36/50.5 X |
| 4,787,124 | 11/1988 | Pozzobon et al. | 36/50.5 X |

FOREIGN PATENT DOCUMENTS

| | | | |
|---|---|---|---|
| 0043905 | 3/1919 | Sweden | 36/50.1 |
| 0451748 | 5/1968 | Switzerland | 36/50.5 |

*Primary Examiner*—Jimmy G. Foster
*Assistant Examiner*—Ted Kavanaugh
*Attorney, Agent, or Firm*—Hugh E. Smith

[57] ABSTRACT

A shoe member includes a plurality of securement webs directed about a lacing gap within the shoe upper, wherein the webs are each mounted slidably within associated cavities, with tether lines mounted to the webs operative above a crank pulley, with the crank pulley in operative engagement with a slidable actuator rod to effect projection of the securement webs forcibly within each respective cavity, wherein a gas cylinder is operative to effect rotation of the crank pulley by use of an associated slide rod within a guide cylinder to effect winding of each associated tether line relative to each associated securement web.

7 Claims, 4 Drawing Sheets

PNEUMATIC SHOE LACING APPARATUS

BACKGROUND OF THE INVENTION

1. Field of the Invention

The field of invention relates to shoe apparatus, and more particularly pertains to a new and improved pneumatic shoe lacing apparatus wherein the same is arranged to pneumatically effect automatic securement of an individual's foot within the associated shoe structure.

2. Description of the Prior Art

Various pneumatic devices in association with shoe apparatus has been available in the prior art for convenience, comfort, and amusement of individuals utilizing such shoe structure. Such apparatus is exemplified in U.S. Pat. No. 4,722,131 to Huang setting forth in air cushioned sole for shock absorbing efficacy in a shoe construction.

U.S. Pat. No. 4,844,194 to De Alessi, et al. sets forth a further example of an air cushion shoe in operative association with compressed gas.

U.S. Pat. No. 4,673,007 to Huang sets forth an air and liquid pump for cushion shoes.

U.S. Pat. No. 4,779,359 to Famolare, Jr. sets forth a further example of a shoe sole utilizing a cushioned plurality of chambers.

U.S. Pat. No. 4,420,893 to Stephan sets forth a shoe structure utilizing an organization to direct pressurized air about the interior surface of the shoe construction.

As such, it may be appreciated that there continues to be a need for a new and improved pneumatic shoe lacing apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shoe apparatus now present in the prior art, the present invention provides a pneumatic shoe lacing apparatus is arranged for the pneumatic lacing of shoes in operative association with a gas cylinder reservoir supply. As such, the general purpose of the present invention, which will be described subsequently in greater detail, is to provide a new and improved pneumatic shoe lacing apparatus which has all the advantages of the prior art shoe apparatus and none of the disadvantages.

To attain this, the present invention provides a shoe member including a plurality of securement webs directed about a lacing gap within the shoe upper, wherein the webs are each mounted slidably within associated cavities, with tether lines mounted to the webs operative about a crank pulley, with the crank pulley in operative engagement with a slidable actuator rod to effect projection of the securement webs forcibly within each respective cavity, wherein a gas cylinder is operative to effect rotation of the crank pulley by use of an associated slide rod within a guide cylinder to effect winding of each associated tether line relative to each associated securement web.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pneumatic shoe lacing apparatus which has all the advantages of the prior art shoe apparatus and none of the disadvantages.

It is another object of the present invention to provide a new and improved pneumatic shoe lacing apparatus which may be easily and efficiently manufactured and marketed.

It is a further object of the present invention to provide a new and improved pneumatic shoe lacing apparatus which is of a durable and reliable construction.

An even further object of the present invention is to provide a new and improved pneumatic shoe lacing apparatus which is susceptible of a low cost of manufacture with regard to both materials and labor, and which accordingly is then susceptible of low prices of sale to the consuming public, thereby making such pneumatic shoe lacing apparatus economically available to the buying public.

Still yet another object of the present invention is to provide a new and improved pneumatic shoe lacing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
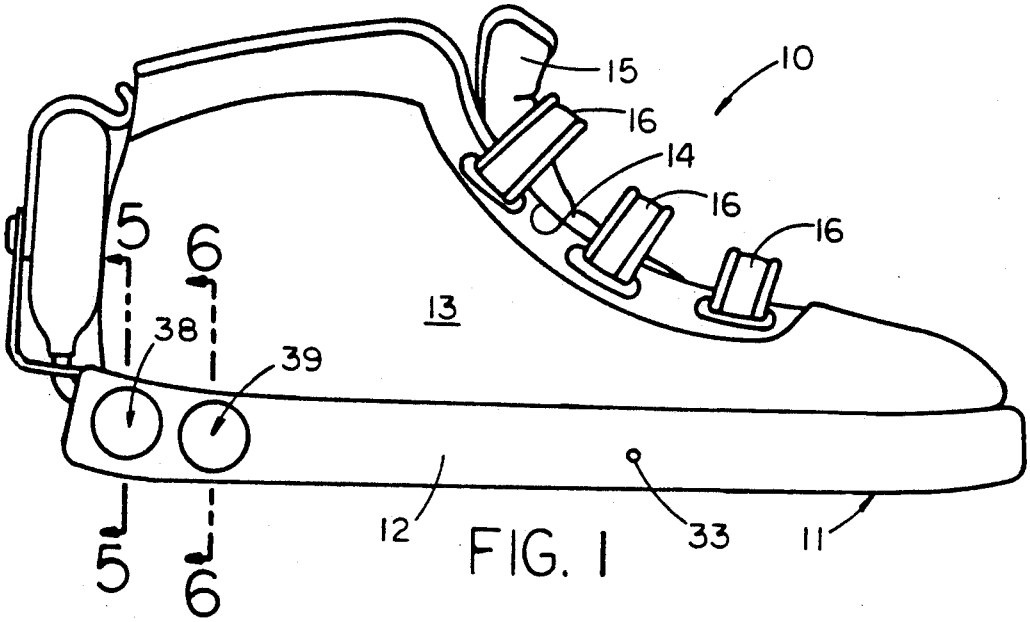
FIG. 1 is an orthographic side view of the instant invention.
Figure 2:
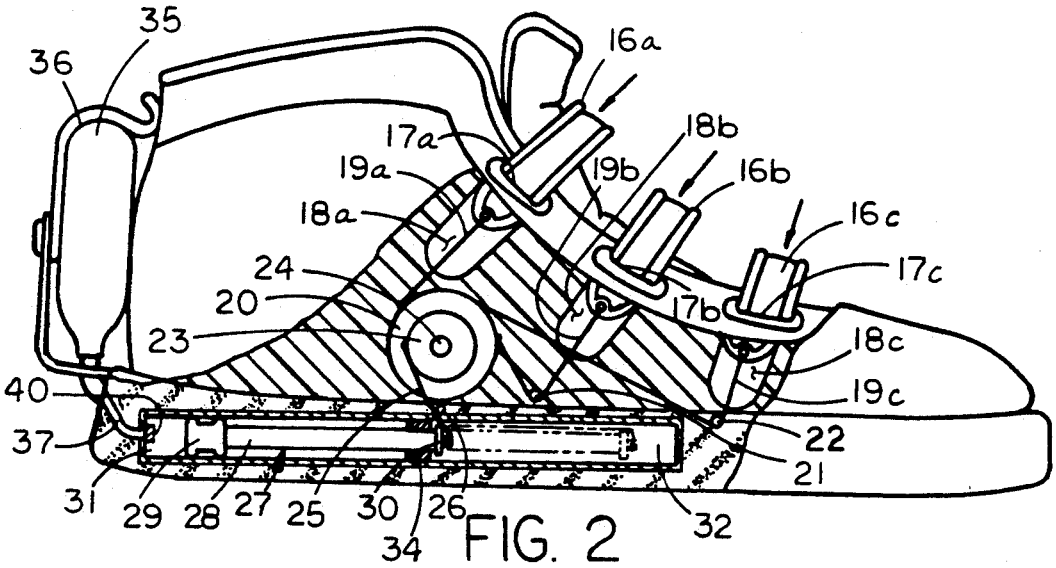
FIG. 2 is an orthographic side view, partially in section, of the invention.
Figure 3:
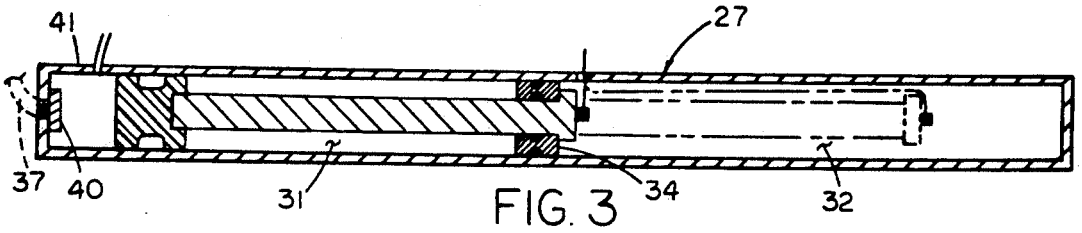
FIG. 3 is an orthographic cross-sectional illustration of the guide cylinder utilized by the invention.

With reference now to the drawings, and in particular to FIGS. 1 to 9 thereof, a new and improved pneumatic shoe lacing apparatus embodying the principles and concepts of the present invention and generally designated by the reference numerals 10, 10*a*, and 10*b* will be described.

More specifically, the pneumatic shoe lacing apparatus 10 of the instant invention essentially comprises a shoe to include a shoe sole 11 that includes a shoe sole side wall 12. A flexible shoe upper 13 extends upwardly and coextensively relative to the shoe sole 11. The shoe upper 13 includes an elongate lacing gap 14 projecting along a top wall of the shoe upper, with a shoe tongue 15 positioned below the lacing gap and a plurality of securement webs to include a first, second, and third respective securement web 16*a*, 16*b*, and 16*c* mounted above the lacing gap in a spaced relationship relative to one another, with the securement webs mounted into the shoe upper sides adjacent the gap 14. A respective first, second, and third slot 17*a*, 17*b*, and 17*c* receive the respective first, second, and third securement webs 16*a*, 16*b*, and 16*c*. The respective slots are arranged relative to respective first, second, and third receiving cavities 18*a*, 18*b*, and 18*c* that are substantially orthogonally oriented relative to the gap 14. A flexible first, second, and third tether line 19*a*, 19*b*, and 19*c* is mounted to an end portion of each respective first, second, and third web 16*a*, 16*b*, and 16*c* to effect displacement and pulling of each web into each associated cavity. A crank pulley 20 is rotatably mounted about a crank pulley axle 24 below the cavities 18*a*, 18*b*, and 18*c*, with a crank pulley hub 23 positioned coaxially and fixedly mounted to the crank pulley 20. The crank pulley 20 includes the first tether line tangentially aligned and secured to the crank pulley, with a second tether line 19*b* wound about a second tether line idler pulley 21, and the third tether line 19*c* wound about and directed around the third tether line idler pulley 22. The second and third tether lines are thereafter secured to the crank pulley 20. The crank pulley hub includes a hub actuator cable 25 that includes a first end mounted to the hub 23 and a second end mounted to a forward distal end or fly rod head 30 of an associated slide rod 28. The forward or second distal end of the slide rod 28 mounts the slide rod head 30 having secured thereto the actuator cable 25, with the slide rod 28 slidably mounted within a tubular guide cylinder 27 whose first distal end spaced from the second distal end mounts a slide rod piston 29 in a sealing relationship within the guide cylinder 27. Cable guide rods 26 positioned above the guide cylinder 27 guide the actuator cable 25 therethrough to maintain alignment in a non-binding relationship of the actuator cable 25 relative to the slide rod head 30. A guide bushing 34 slidably receiving the slide rod 28 therethrough divides the guide cylinder 27 into a first and second chamber portion 31 and 32 respectively, with a piston 29 positioned within the first chamber portion and the slide rod head positioned within the second chamber portion. A vent conduit 33 (see FIG. 1) directed through the shoe sole side wall 12 is in pneumatic communication with the second chamber portion 32 for venting upon projection of the slide rod 28 within the second chamber portion 32 of the guide cylinder 27. A pressurized gas cylinder 35 mounted to the shoe upper support bracket 36 includes a gas cylinder supply conduit 37 is operative communication with the gas cylinder 35 and directed through the shoe sole side wall 12 into a guide cylinder rear end wall 41. A first valve 38 effects effective pressurizing of the first chamber portion 31 for effecting rotation of the crank pulley 20 and projection of the securement webs 16*a*, 16*b*, and 16*c* into the respective cavities, wherein pressurizing of the first chamber portion effects projection of the slide rod head 30 forwardly and projection of the actuator cable 25 within the second chamber portion thereby effecting rotating of the crank pulley 20 and a winding of each of the tether lines 19*a*, 19*b*, and 19*c* about the crank pulley. The second valve 39 effects release of pressure from the first chamber portion to eliminate tensioning from the securement webs permitting an individual ease of removal and mounting of the shoe relative to that individual. The first valve 38 includes a first valve guide plate 40, with the first valve plate 40 slidably mounted in contiguous communication with the guide cylinder rear end wall 41. A valve plate conduit bore 42 is mounted through the first valve plate 40 (see FIG. 5), wherein a first position is displaced relative to the gas cylinder supply conduit 37 and in a second position upon projection and depressing of the valve plate head 43 against an associated valve plate spring 44 that is captured between the guide cylinder 27 and the side wall 12, aligns the valve plate conduit bore 42 with the gas cylinder supply conduit 37 effecting pressurizing of the first chamber portion 31 and associated projection of the slide rod 28 into the second chamber portion 32, in a manner as noted above. Slide rod head 30 includes a pressure release chamber 45 that is in pneumatic communication through a guide cylinder conduit 46 into the first chamber portion 31, wherein a pressure release rod 47 includes an interior flange 48 in surrounding relationship with an interior surface of the side wall 12 within the pressure release chamber 45. In a second valve first position, the interior flange 48 is in sealing relationship relative to the side wall 12, wherein in a second displaced position upon manual displacement of the release rod head 50 against the interior flange spring 49 that is captured between the guide cylinder 27 and the interior flange 48, permits escape or venting of pressurized gas from within the first chamber portion 31 through the guide cylinder conduit 46, the pressure release chamber 45, and through the side wall 12 about the release rod 47.

Figure 4:
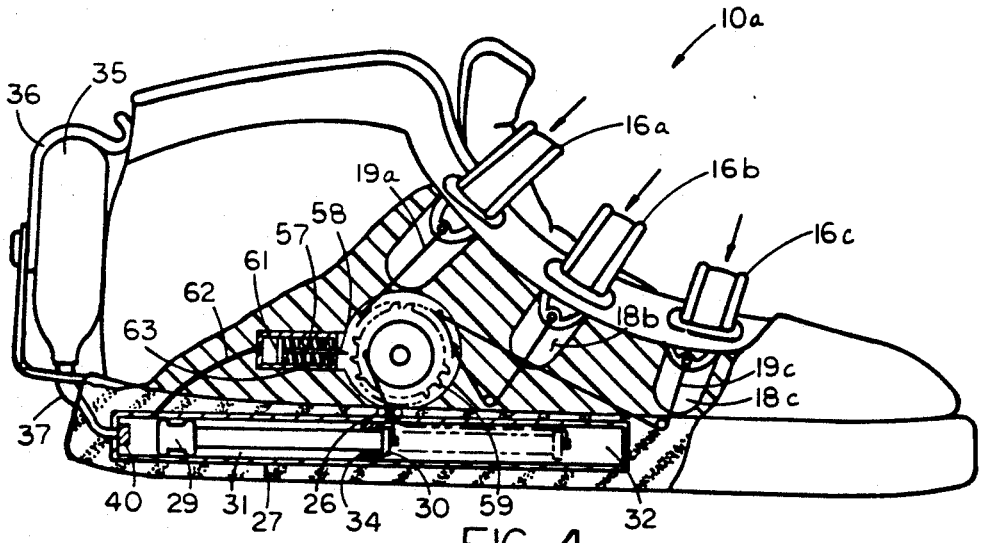
FIG. 4 is an orthographic side view, partially in section, of a modified aspect of the invention.
Figure 5:
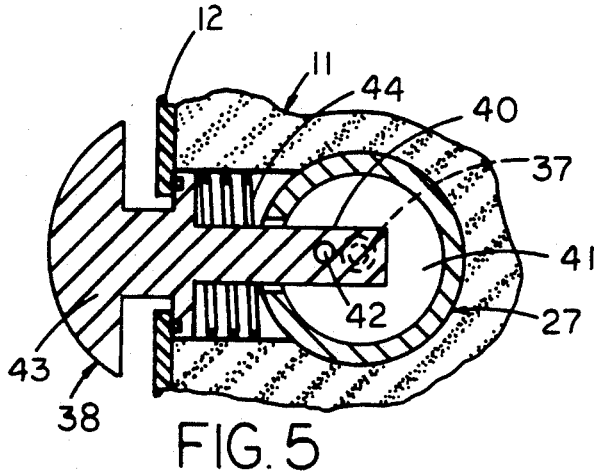
FIG. 5 is an orthographic view, taken along the lines 5—5 of FIG. 1 in the direction indicated by the arrows.
Figure 6:
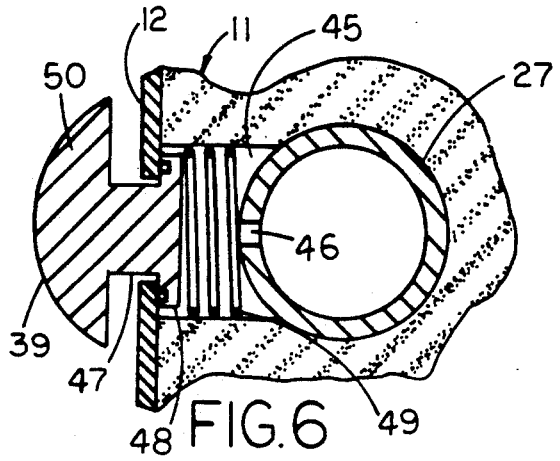
FIG. 6 is an orthographic view, taken along the lines 6—6 of FIG. 1 in the direction indicated by the arrows.

The apparatus 10*b*, as illustrated in FIG. 4, further includes a locking rod 57 that is radially oriented relative to the crank pulley 20, with the locking rod 57 including a locking rod forward end 58 that is in selective operative engagement with a crank pulley tooth periphery 59, whereupon pressurizing of the first chamber portion 31, a locking rod chamber conduit 62 directs pressurized gas into a locking rod chamber 60 directing pressurized gas to a rear surface of a locking rod piston 61 that orthogonally and coaxially mounts the locking rod 57. The piston 61 is thereby projected forwardly projecting the locking rod 57, and more specifically the locking rod forward end 58, into a ratcheting engagement with the tooth periphery 59 to provide for a locking mechanism for locking the crank pulley and a securement of the webs 16*a*, 16*b*, and 16*c* in a laced orientation relative to the shoe construction. A locking rod biasing spring 63 upon release of pressure relative to the first chamber portion 31 biases a piston 61 rearwardly within the locking rod chamber 60 disengaging the locking rod 57 relative to the tooth periphery 59 of the crank pulley 20.

Figure 7:
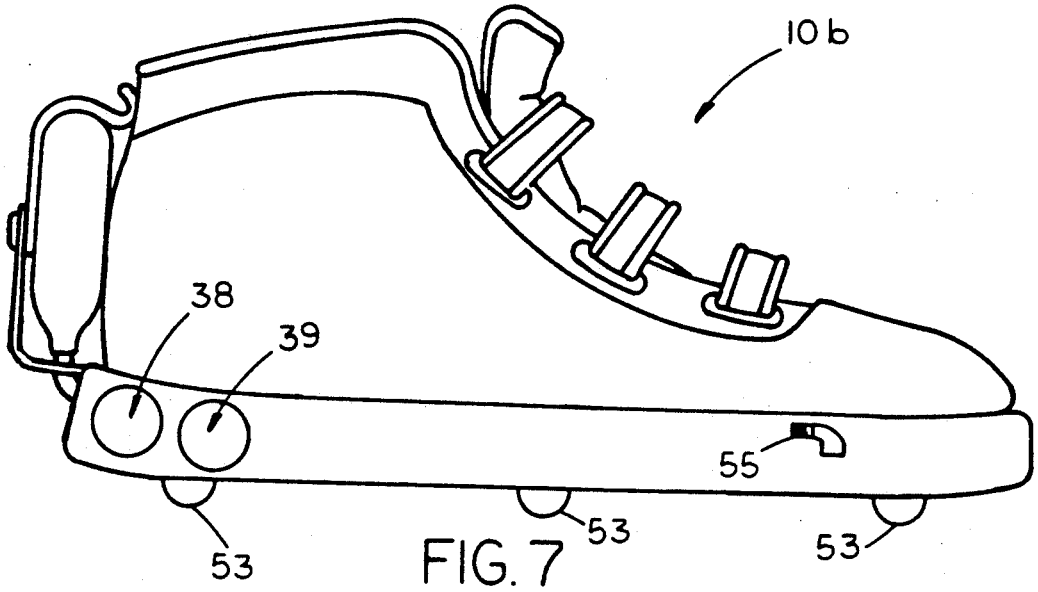
FIG. 7 is an orthographic side view of a further modification of the invention.
Figure 8:
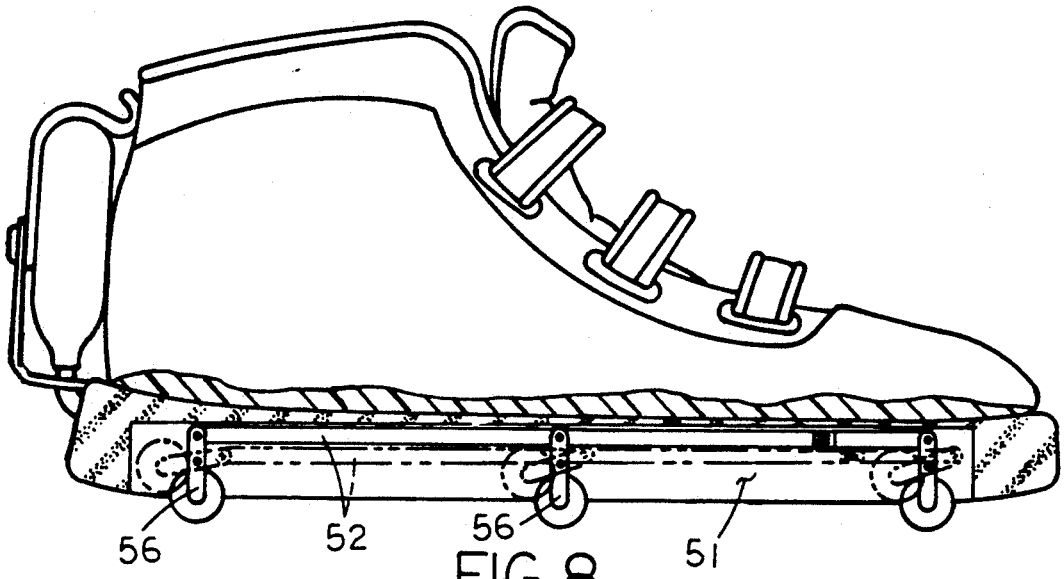
FIG. 8 is an orthographic side view of the modification of the invention, partially in section, illustrating the roller wheels arranged in an operative orientation relative to the shoe sole.
Figure 9:
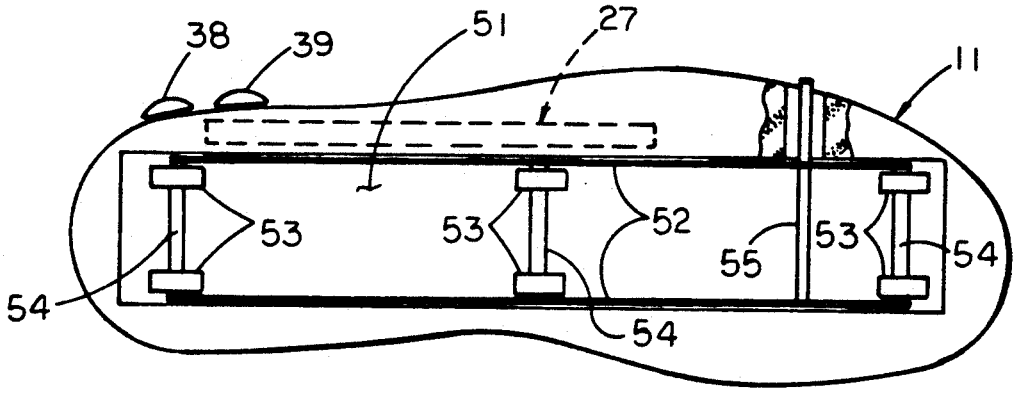
FIG. 9 is an orthographic bottom view of the shoe sole set forth in FIG. 8.

The FIGS. 7–9 illustrate the use of a shoe skating construction utilized with the invention, wherein the shoe sole cavity 51 includes a plurality of parallel links 52 mounted within the shoe sole cavity 51, with plural pairs of roller links pivotally mounted in a parallel relationship relative to the links 52, with each of the links 56 rotatably mounting a roller 53 at its lower distal end. An actuator link 55 is slidably mounted through the shoe sole cavity 51 secured to the parallel links 52, wherein displacement rearwardly of the actuator link 55 effects pivotment of the roller pairs 53 that are each in turn mounted to an axle 54 that are in a parallel relationship relative to one another and orthogonally oriented relative to the parallel cavity links 52 to provide for a roller skating mechanism relative to the shoe construction 10*b*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pneumatic shoe lacing apparatus, comprising, a shoe assembly, including a shoe sole, the shoe sole including a shoe sole side wall, and a shoe upper mounted to the shoe sole extending upwardly thereof, the shoe upper including an upper top wall, and the top wall including an elongate lacing gap, the lacing gap including a tongue positioned below the lacing gap coextensively thereof, and a plurality of securement webs mounted above the lacing gap, with the securement webs including at least a first web and a second web, and the first web and the second web mounted to a first side of the lacing gap, and the first web and the second web mounted to a second side of the lacing gap, and the first web and the second web slidably directed through a respective first slot and second slot through the second side of the lacing gap into the shoe upper, and the first web and the second web including a respective first cavity and second cavity receiving the first web and the second web, and a first tether line mounted to the first web, with the first tether line directed through the first cavity, and a second tether line mounted to the second web when the second tether line is directed through the second cavity, and a crank pulley rotatably mounted within the shoe upper above the side wall, with the crank pulley including said first tether line and said second tether line mounted thereto, and drive means arranged for rotation of the crank pulley, with the drive means mounted within the shoe sole effecting selective rotation of the crank pulley and winding of the first tether line and the second tether line about the crank pulley.

2. An apparatus as set forth in claim 1 wherein the crank pulley is rotatably mounted about a crank pulley axle, and the crank pulley includes a crank pulley hub, the crank pulley hub including a hub actuator cable, the hub actuator cable mounted to the crank pulley hub at a first distal end of the hub actuator cable and a second end of the hub actuator cable mounted to the drive means, and the drive means arrange for reciprocation within the shoe sole for effective rotation of the crank pulley hub upon projection of the drive means within the shoe sole.

3. An apparatus as set forth in claim 2 wherein the first tether line is tangentially aligned relative to the crank pulley, and the second tether line including a second tether line idler pulley, with the second tether line directed about the second tether line idler pulley and mounted to the crank pulley spaced from the first tether line.

4. An apparatus as set forth in claim 3 wherein drive means includes a tubular guide cylinder, and a slide rod slidably mounted within the tubular guide cylinder, and the slide rod including a slide rod piston mounted to a rear distal end of the slide rod, and a slide rod head mounted to a forward distal end of the slide rod, and a guide bushing mounted within the tubular guide cylinder medially of the guide cylinder, with the slide rod piston slidably mounted within the guide cylinder rearwardly of the guide bushing, and a forward distal end of the slide rod including a slide rod head mounted within the guide cylinder forwardly of the guide bushing, and the guide bushing defining a first chamber portion containing the slide rod piston, and a second chamber portion mounting the slide rod head, and the hub actuator cable mounted to the slide rod head, and a vent conduit directed through the shoe side wall into the second chamber portion for venting of the second chamber portion.

5. An apparatus as set forth in claim 4 including a pressurized gas cylinder mounted to the shoe sole, and a gas cylinder supply conduit directed pneumatically from the gas cylinder into the first chamber portion, with the first chamber portion including a guide cylinder rear end wall and the gas cylinder supply conduit directed through the rear end wall, and the first valve including a first valve plate, the first valve plate in contiguous and sliding communication with the guide cylinder rear end wall, the valve plate including a valve plate conduit, the valve plate conduit displaced relative to the gas cylinder supply conduit in a first position, and wherein the valve plate conduit aligned with the gas cylinder supply conduit in a second position, and the first valve plate radially directed through the guide cylinder and orthogonally directed through the shoe sole side wall, and the valve plate including a valve plate head mounted to an outer end of the valve plate exteriorly of the shoe sole side wall, and a valve plate spring mounted between the guide cylinder and the shoe sole side wall to bias the valve plate in the first position, and the valve plate head is arranged for manual depressing against the shoe sole side wall to the second position.

6. An apparatus as set forth in claim 5 including a second valve in pneumatic communication with the first chamber portion, the second valve including a pressure release chamber in pneumatic communication with the guide cylinder through a guide cylinder conduit, and the second valve including a pressure release rod, the pressure release rod including an interior flange in operative engagement with an interior surface of the shoe sole to include a pressure release spring captured between the pressure release interior flange and the guide chamber to bias the pressure release interior flange into engagement with the side wall, and the pressure release rod including a pressure release head positioned exteriorly of the side wall permitting projection of the interior flange in a spaced relationship relative to the shoe sole side wall permitting venting of pressurized gas from the first chamber portion through the guide cylinder conduit and the release chamber about the pressure release rod.

7. An apparatus as set forth in claim 6 including a locking rod chamber conduit in pneumatic communication with the first chamber, and the chamber conduit including a locking rod chamber spaced from the chamber, the locking rod chamber including a locking rod coaxially directed through the locking chamber radially oriented relative to the crank pulley, the crank pulley including a tooth periphery, and the locking rod including a locking rod forward end in selective engagement with the tooth periphery, and the locking rod including a locking rod piston fixedly and orthogonally mounted to a rear distal end of the locking rod and the locking rod chamber conduit in pneumatic communication with a rear surface of the piston, with the locking rod fixedly mounted to a forward surface of the piston, and a biasing spring mounted within the locking rod chamber to bias the piston in a displaced relationship adjacent the locking rod chamber conduit, wherein pressurizing of the first chamber effects displacement of the locking rod piston relative to the chamber conduit and engagement with the locking rod forward end relative to the crank pulley tooth periphery.

* * * * *